US006845975B2

(12) United States Patent
Tünkers

(10) Patent No.: US 6,845,975 B2
(45) Date of Patent: Jan. 25, 2005

(54) POWER-DRIVEN TOGGLE-LEVER CLAMPING DEVICE

(75) Inventor: Josef-Gerhard Tünkers, Ratingen (DE)

(73) Assignee: Tunkers Maschinenbau GmbH, Ratingen (DE)

( * ) Notice: Subject to any disclaimer, the term of this patent is extended or adjusted under 35 U.S.C. 154(b) by 0 days.

(21) Appl. No.: 10/478,359

(22) PCT Filed: Sep. 12, 2002

(86) PCT No.: PCT/EP02/10221

§ 371 (c)(1),
(2), (4) Date: Jan. 12, 2004

(87) PCT Pub. No.: WO03/047815

PCT Pub. Date: Jun. 12, 2003

(65) Prior Publication Data

US 2004/0113342 A1 Jun. 17, 2004

(30) Foreign Application Priority Data

Dec. 6, 2001 (DE) ..... 101 59 874

(51) Int. Cl.[7] ..... B25B 1/06
(52) U.S. Cl. ..... 269/225; 269/32
(58) Field of Search ..... 269/225, 228, 269/32, 24, 27, 20, 226

(56) References Cited

U.S. PATENT DOCUMENTS

| | | | | | |
|---|---|---|---|---|---|
| 4,635,911 | A | | 1/1987 | Lovrenich | |
| 4,700,936 | A | | 10/1987 | Lunn | |
| 4,770,401 | A | * | 9/1988 | Donaldson | 269/249 |
| 6,338,476 | B1 | * | 1/2002 | Takahashi | 269/32 |
| 6,565,074 | B1 | * | 5/2003 | Wheeler | 269/32 |
| 6,585,246 | B2 | * | 7/2003 | McCormick et al. | 269/239 |
| 6,612,557 | B2 | * | 9/2003 | Sawdon et al. | 269/32 |

FOREIGN PATENT DOCUMENTS

| | | |
|---|---|---|
| DE | 3 613 644 | 4/1986 |
| DE | 196 16 441 | 4/1996 |
| DE | 297 01 730 | 2/1997 |
| EP | 0 895 830 | 2/1998 |
| FR | 2 765 650 | 7/1997 |

* cited by examiner

*Primary Examiner*—Lee D. Wilson
(74) *Attorney, Agent, or Firm*—Baker & Daniels

(57) ABSTRACT

An implement comprising a head part and a drive part adjoining the head part in a longitudinal direction. The drive part is associated with an actuating member which is drivable in opposite directions. The actuating member is coupled to a toggle lever mechanism via which mechanism an arm of a toggle-lever device is drivable.

23 Claims, 3 Drawing Sheets

POWER-DRIVEN TOGGLE-LEVER CLAMPING DEVICE

"The present application claims priority under 35 U.S.C. §120 to PCT International Application Serial Number PCT/EP02/10221, filed Sep. 12, 2002, which is expressly incorporated herein by reference."

BACKGROUND AND SUMMARY OF THE INVENTION

The invention relates to an implement having a head part, a drive part adjoining the head part in the longitudinal direction, which drive part is associated with an actuating member which is drivable in opposite directions, which actuating member is connected transmission-wise to a toggle lever mechanism via which mechanism a clamping arm of a toggle-lever clamping device (or a welding electrode of a toggle-lever welding arm, or a broach or other mandrel, or an impressing or stamping device) is drivable, for use in automotive body manufacturing in the automotive industry, wherewith the drive part has an electric motor which drives the toggle lever mechanism via a transmission device.

There are many forms of implements in the known art which satisfy the above general description.

Inter alia, so-called toggle-lever clamping devices are known, in which a head part in the form of a force-exerting head (clamping head) is connected to a piston and cylinder unit which has a piston movable in two directions via a pressure medium such as compressed air, wherein the piston plunger extends into the inner space of the force-exerting head (clamping head) which head accommodates a toggle lever mechanism via which mechanism a clamping arm is drivable which can be advanced and retracted around a shaft (swing pin) which is fixed to the housing, whereby, e.g., vehicle body components (sheet metal and the like) can be clamped. As a rule, in this connection such so-called toggle-lever clamping devices also have an opposing jaw member to enable clamping of the vehicle body component(s) between the clamping arm and the opposing jaw member.

Toggle-lever clamping devices of this type are described in, e.g., DE 196 16 441 C1.

EP 1 066 929 A2 discloses a toggle-lever clamping device wherein the drive part comprises an electric motor.

Also known is the use of toggle lever mechanisms for "clinch" apparatuses whereby sheet metal parts which are to be joined are subjected to very high local pressure and are deformed to the extent of incipient flow, resulting in a bond analogous to spot welding.

Toggle-lever clamping devices are also known in the form of impressing or stamping devices. The high force generated by the device is employed e.g. for stamping numbers and letters and other markings onto/into articles, generally articles comprised of metal. In particular, such stamping devices are used for stamping vehicle frame numbers or the like, in automotive manufacture.

DE 199 42 390 A1 discloses implements of the general type described in "Specific area" supra, employing a toggle-lever welding arm (welding arm driven by a toggle lever mechanism). Here a welding electrode is associated with the clamping arm, and the opposing electrode may be connected with the opposing jaw member opposed to the clamping arm. The metal sheets which are to be permanently joined are placed between the electrodes and are welded together by spot welding.

DE 36 13 644 A1 relates to a toggle-lever clamping device for holding of workpieces, particularly in automotive body manufacturing, having an axially adjustable member which actuates the toggle lever mechanism and which is associated with an electric drive which provides the axial movement. The electric drive drives a screw spindle or helical ball bearing screw spindle or the like, via an intermediate gear. The axially adjustable part may also be driven by an electrical linear motor.

U.S. Pat. No. 4,700,936 relates to a clamping device wherein an angle lever is driven by a worm drive. The worm drive is disposed outside the contours of the device head, which arrangement increases the apparatus size. For broaches, other mandrels, welding devices, and centering devices, employing toggle-lever clamping devices or toggle lever mechanisms, for the automotive industry (automotive body manufacture), this device cannot be used for this reason (non-compactness).

The underlying problem of the invention is to devise an implement of the general type described initially supra ("Specific area"), particularly for use in body manufacture in the automotive industry, which has a robust and structurally simple engineering design and substantially allows use of customary commercially available components.

In the inventive implement the drive part employs an ordinary commercially available electric motor, DC or AC or 3-phase or polyphase, 24 V or 220 V, which is attached directly to the head part by flange means, and the actuating member is driven by a transmission, which may be e.g. a worm drive. Electric motors of this type are employed with the selection of the motor depending on the desired power and performance.

A worm drive is robust and enables a large number of operating cycles (reciprocal excursions of the actuating member). Because only two drive elements are required for force transmission, viz. a worm gear wheel and a worm, the sealing problems which arise, e.g. when compressed air drive is employed, do not exist. Also it is unnecessary to run (have available) compressed air lines, because the motor is supplied with energy through an electric cable, which is convenient and compact. Further, the parts are relatively easy to disassemble for maintenance and repair. The electric motor can be separated from the head part quickly and easily, in order to replace said motor or perform maintenance on it. Worms and worm gear wheels can be readily accommodated inside the dimensions of the head part used as a clamping head in toggle-lever clamping devices or the like; thus it is unnecessary to increase the device dimensions. Thus implements having the inventive construction can be used anywhere toggle-lever clamping devices, toggle-lever welding arms, stamping tools, impressing tools, "clinch" tools, or clamping or broaching cylinders employing rods, have been used, e.g. for body manufacture in the automotive industry.

According to the invention the worm is rotatably mounted on the motor shaft which is drivable in two opposite directions by the electric motor. The worm gear wheel is disposed on a rotatably mounted shaft the position of which is fixed in the head part, which shaft can also be rotated in two directions. These shafts, and the worm gear wheel itself, may be disposed in antifriction bearings, which advantageously may be, e.g., needle bearings (to reduce apparatus dimensions).

Advantageously, the worm gear wheel is connected transmission-wise to the toggle lever mechanism and/or to members of the toggle lever mechanism, via a dog (21) and via a swing pivot (23). Because ordinarily the longitudinal axis of the worm and the longitudinal axis of the swing pivot of the worm gear wheel are disposed at a 90° angle (which is a skew angle), these drive parts are arranged compactly in the head part, e.g. in the clamping head of a toggle-lever clamping device.

The longitudinal axis of the swing pivot by which the relevant member of the toggle lever mechanism is connected to the dog member on the worm gear wheel is parallel to the longitudinal axis of the worm gear wheel.

Overall, the invention provides the advantage that the drive means can be accommodated in the clamping head, in space-saving fashion. At the same time, an ordinary commercially available electric motor may be used, and a robust worm drive. The worm and worm gear wheel can be housed inside the normal dimensions of the clamping head of, e.g., an implement in the form of a toggle-lever clamping device, without having to increase the dimensions of the device.

According to an illustrated embodiment, the worm shaft can be readily rotatably mounted in the head part, via two bearings spaced a distance apart, which bearings may comprise, e.g., antifriction bearings (needle bearings, ball bearings, or the like).

Illustratively, each of the levers connected to the dog member of the worm gear wheel is comprised of at least two lever members the longitudinal axes of which are at a mutual oblique angle, such that the apex of the angle is directed generally away from the longitudinal axis of the worm.

In this way one provides a large excursion path of the actuating member driven by the toggle lever mechanism; and the lever members of the toggle lever mechanism are accommodating toward the contour of the worm gear wheel so as not to interfere with it as they are driven by the electric motor, so that without increasing the transverse dimensions of customary clamping heads of toggle-lever clamping devices or the like it is possible to house all of these drive parts in the head part.

According to an illustrated embodiment part of the toggle lever mechanism is readily movably but forcibly guided via inner slot-shaped guide grooves which extend mutually parallelly in the longitudinal direction of the head part. These grooves are of identical shape.

According to an illustrated embodiment, the guiding is via rolls which have antifriction bearings, which bearings may advantageously be needle bearings in order to save space.

According to an illustrated embodiment, a shaft of the worm gear wheel (which shaft preferably has antifriction bearings) extends out of the head part without a loss of the sealing of the interior of the head part, such extension being on at least one side but preferably on both sides, wherewith the extended part of the shaft has a suitable coupling configuration to have a hand lever mounted on it. In this manner, if needed the implement can also be actuated manually, e.g. in the clamping position or in the open position.

According to an illustrated embodiment position sensing elements are disposed in the region of the toggle lever mechanism. These elements may be microswitches, inductive switches, or pneumatic switches, which are disposed on a replaceable module which is referred to in the industry as a "set" or "cassette". These sensors may provide remote monitoring of, e.g., the clamping position of a clamping arm of a toggle-lever clamping device, the position of a centering mandrel, or the position of electrodes of toggle-lever welding devices or the like. These elements may enable connection of acoustic and/or optical indicating devices, e.g. in the form of light-emitting diodes, lamps, or the like, by electrical or electronic means, which devices provide remote monitoring of the position of a given actuating member, wherewith the monitoring appears e.g. at a remote control post where a number of implements are monitored, particularly toggle-lever clamping devices in factories for automobile bodies in the automotive industry According to an illustrated embodiment, advantageously the described replaceable module can be inserted/accommodated in the head part from all four sides.

The longitudinal slots therefore which are not needed (not in use) are closed off by suitable means, e.g. sheet metal pieces.

According to an illustrated embodiment, attachment means in the form of threaded blind holes, quick connections, throughgoing bores, or the like may be provided on all four sides (front, rear, and lateral) of the head piece, facilitating the positioning of the module which is insertable in the longitudinally extending narrow slot in the head part. Also, e.g., threaded blind holes may be provided on both sides of the slot, in order to facilitate positioning of the overall apparatus, e.g. for integrating the apparatus into the body assembly line of an automobile factory. Numerous opportunities for so integrating the inventive implement are thus provided.

According to an illustrated embodiment, the transmission means is self-locking.

According to an illustrated embodiment, the implement has a battery for emergency power supply purposes, which battery may be associated with the drive part and may be automatically charged/recharged by operation of the motor, wherewith when there is a power failure the battery automatically provides electricity for operating the implement.

According to an illustrated embodiment, the worm and/or the worm gear wheel is/are comprised of materials which have operating characteristics which enable continued operation under emergency conditions. For example, the worm and/or the worm gear wheel may be comprised of a suitable plastic material a component of which is flakes (or the like) of polytetrafluoroethylene (PTFE). E.g. the worm and/or worm gear wheel may be formed by casting or injection molding, and they may have contours formed (by machining or the like) into their surfaces such that pieces of such PTFE bodies (flakes or the like) become prominent or exposed, whereby the interengaging surface areas of the worm and worm gear wheel can operate for an extended period without lubrication.

BRIEF DESCRIPTION OF THE DRAWINGS

The drawings illustrate the invention (partially schematically) for purposes of example.

DETAILED DESCRIPTION OF THE DRAWINGS

Figure 3:
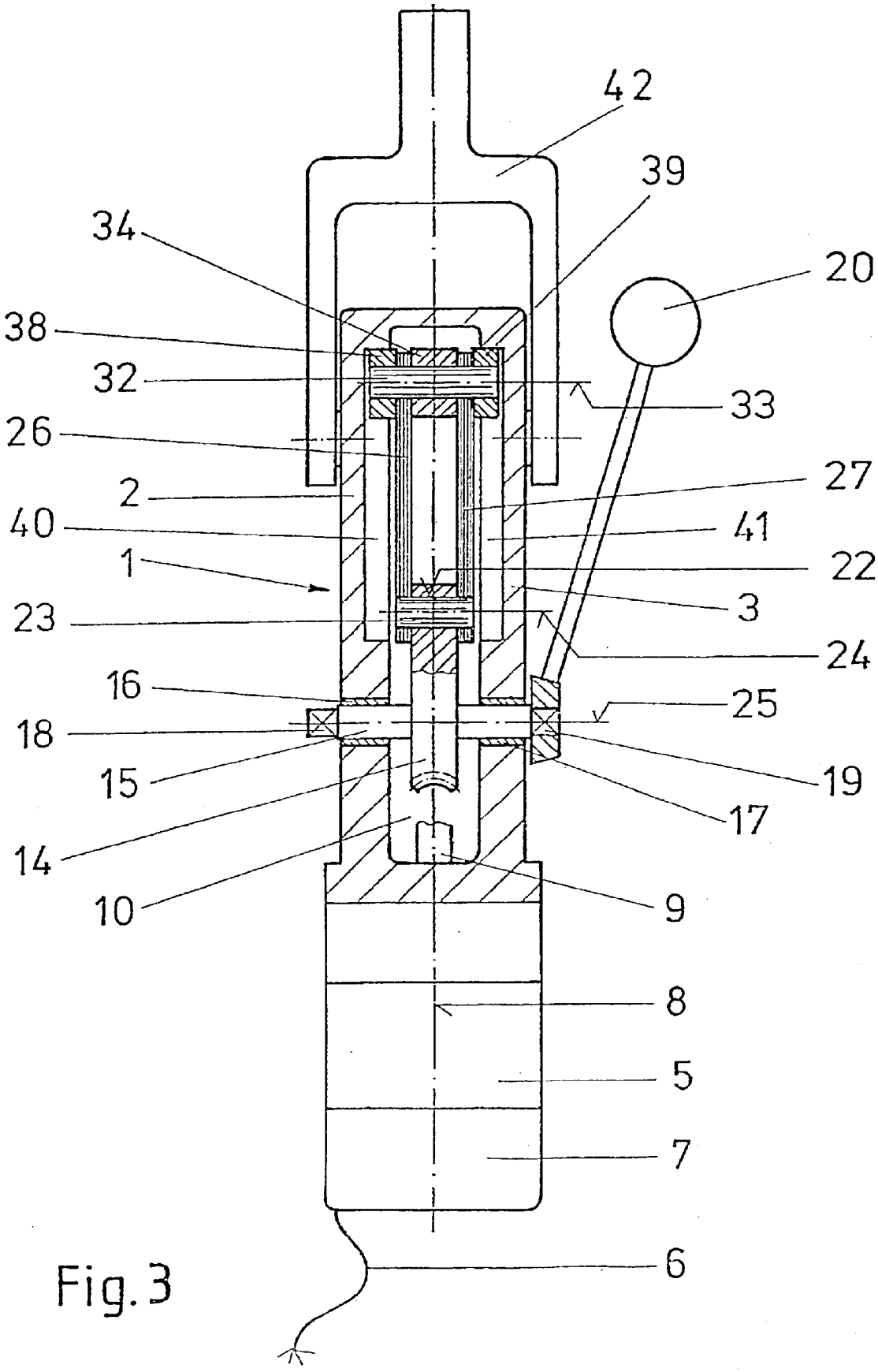
FIG. 3 is a cross section through line III—III of FIG. 1 wherein a laterally disposed hand lever is provided for manual actuation of the implement.

The head part 1 of the stressing head (clamping head) has two housing parts 2, 3 the walls of which abut each other to form a flush and sealed joint. Housing parts 2 and 3 are joined together by screws (not shown), resulting in a space which is closed to the exterior and encapsulated (FIG. 3). Toward this end, the housing parts 2 and 3 may be provided with threaded bores (not shown) for engaging the screws.

The longitudinal axis of head part 1 is designated with reference numeral 4. The head part 1 is adjoined in the longitudinal direction by drive part 5 which in the illustrated embodiment is in the form of an electric motor, which may be operated as a low-voltage motor, e.g. 24 volts.

A cable 6 supplies the electric motor 5 with electric power from a suitable source. If necessary the drive part 5 may also comprise a battery in order to continue to supply drive part 5 with power for some time in the event of power failure. The battery may be integrated into the housing of the electric motor 5, e.g. as the part 7. The longitudinal axis of the drive part 5 is indicated with reference numeral 8.

The shaft 9 of the electric motor 5 extends into an inner or interior space 10 of the head part 1, surrounded by housing parts 2 and 3, and said shaft is rotatably mounted in the inner space 10 of head part 1 via bearings 11 and 12 which are spaced a distance apart. The bearings 11 and 12 may comprise antifriction bearings, particularly ball bearings or needle bearings, or in the event of axial thrust forces, tapered bearings or inclined bearings.

A worm 13 is associated with the shaft 9 of drive part 5, which worm is disposed coaxially with the longitudinal axis 8 of the electric motor 5 and can be driven by said motor in different directions of rotation.

The worm 13 engages a worm gear wheel 14 the axle (shaft) 15 of which is at a 90° angle to the rotational axis 8 of the worm 13. Shaft 15 is freely rotatably mounted in housing parts 2 and 3 via bearings 16 and 17. These bearings 16, 17 may comprise antifriction bearings, e.g. needle bearings or ball bearings.

As seen from FIG. 3, in the embodiment illustrated the rotational shaft [i.e. shaft] 15 of the worm gear wheel 14 extends outward from the housing parts 2 and 3 wherewith on its extended part it bears a formed square member 18, 19 or the like onto which a hand lever 20 having a suitable coupling opening can be accommodated on one side or the other, alternatingly, enabling manual actuation of the implement.

Figure 1:
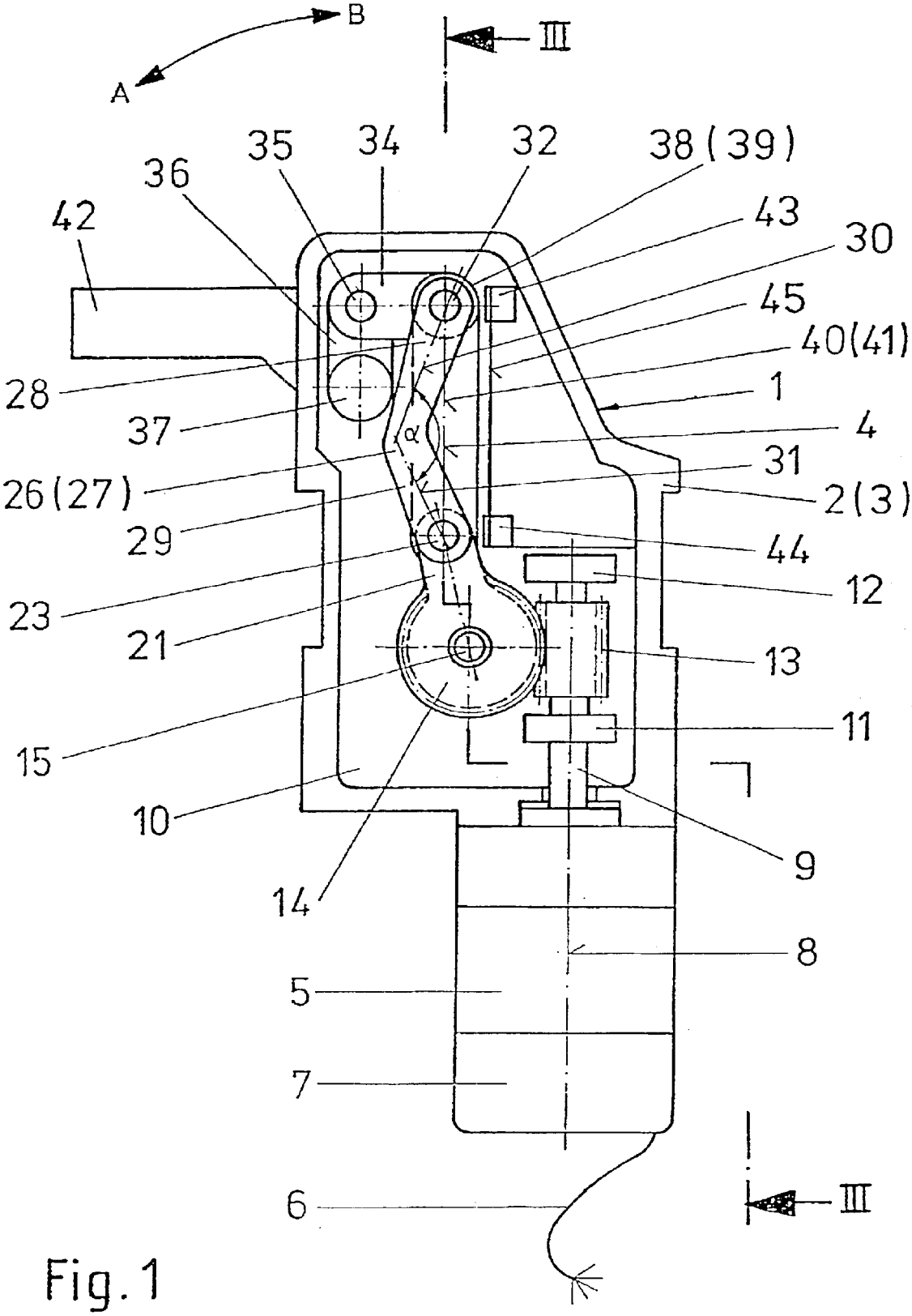
FIG. 1 shows an implement comprising a toggle-lever clamping device according to the invention, with the head part of the implement shown in a cutaway view, and the electric motor shown in an elevation view. The clamping arm is shown in clamping position.
Figure 2:
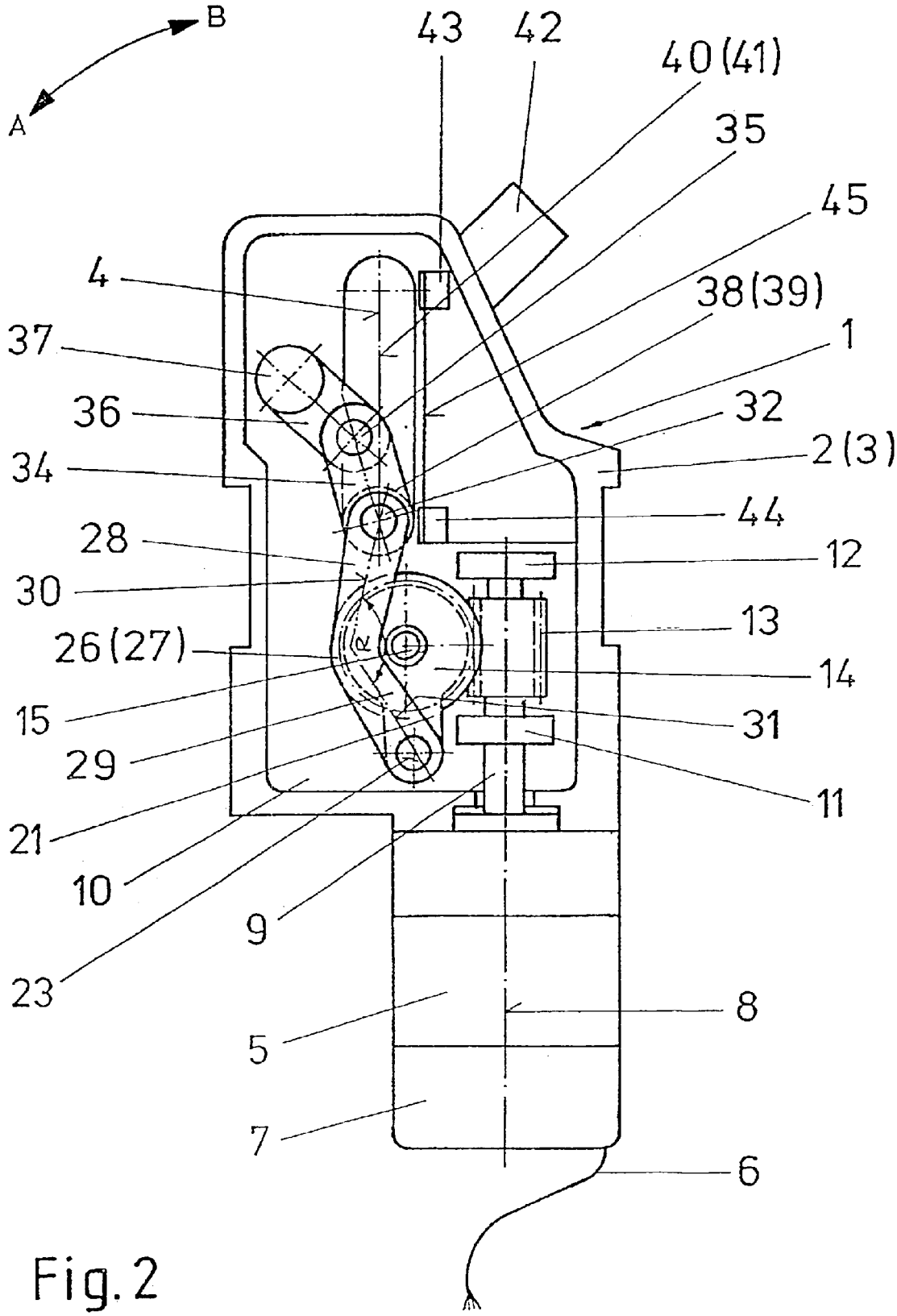
FIG. 2 shows the implement of FIG. 1 wherewith the clamping arm is in the open position.

As may be seen particularly from FIGS. 1 and 2, a dog or the like 21 is present in a unit construction with the worm gear wheel 14, which dog has a bore 22 through which a swing pivot 23 engagingly extends which has its longitudinal axis 24 (FIG. 3) parallel to the longitudinal axis 25 of the shaft 15 (FIG. 3).

The swing pivot 23 extends out beyond the dog 21 on both sides and is connected transmission-wise to respective connecting levers 26, 27 which form part of a toggle lever joint. Each of the connecting levers 26, 27 is comprised of two lever parts joined in unit construction 28, 29. The longitudinal axes 30, 31 of the lever parts 28, 29 form an oblique angle ($\alpha$), the apex of which is directed toward the side of longitudinal axis 4 which is opposite to that on which the worm 13 is disposed (FIGS. 1 and 2).

On the other end of connecting levers 26 and 27 they are swingably connected to a guiding and swinging pin 32 (FIG. 3) the longitudinal axis 33 of which is parallel to the longitudinal axis 24 of swing pivot 23 and thereby also parallel to the longitudinal axis of the shaft 15 of the worm gear wheel 14. The length of the guiding and swinging pin 32 should be chosen such that the connecting levers 26 and 27 swingably engage it in its end regions. This swingable engagement may be of a low-friction type such as via antifriction bearings, particularly needle bearings or ball bearings.

Disposed between the connecting levers 26 and 27 is a member 34 of the toggle lever joint (FIG. 3) which member is swingably disposed in the middle cross sectional plane across the axis of the guiding and swinging pin 32 and may be swingably mounted there via low-friction means such as antifriction bearings, particularly a needle bearing or ball bearing. On the end of member 34 which is opposite to the guiding and swinging pin 32, member 34 is swingably mounted around a swing pivot 35 the longitudinal axis of which is parallel to the longitudinal and swing axis of guiding and swinging pin 32.

At least one and preferably two levers 36 (if two, then spaced a distance apart) is/are swingably mounted on swing pivot 35. Antifriction bearings such as needle bearings or ball bearings may be used for this. On the opposite end of levers 36 said levers are swingably mounted on a swing pin (shaft) 37 which is connected to the housing and which may be fixedly mounted or may itself be swingable (around its longitudinal axis). Swing pin 37 is disposed in bearings which are disposed in the associated housing parts 2, 3. The bearings may comprise antifriction bearings, e.g. needle bearings or ball bearings.

As may particularly be seen from FIG. 3, the length of the guiding and swinging pin 32 is chosen such that on both ends it extends past the ends of the respective bores in the connecting levers 26 and 27. Respective guide rolls 38, 39 are rotatably mounted on these free end segments, and may have antifriction bearings such as needle bearings or ball bearings, so that the articulated parts of the device overall, in particular those of the toggle lever mechanism, are freely swingable (or rotatable). Each of the guide rolls 38, 39 is forcibly guided in a respective longitudinal guide groove 40, 41. The guide grooves 40, 41 are mutually of the same size and configuration (but mirror image); they have the same dimensions, but they are formed in opposite sides of the housing parts 2 and 3, in the inner walls thereof. Thus they are essentially mutually coaxial, so that when the toggle lever executes a stroke the guide rolls 38, 39 are rollably guided at low friction in the guide grooves 40, 41.

In the embodiment illustrated, the swing pin 37 is associated with a clamping arm 42 which is disposed so as to be swingable in the direction A–B, through a specific angular excursion. An opposing member for the clamping arm 42, a so-called jaw member, not illustrated, may be present in any customary form. This opposing member is connected to the head part 1.

Suitable articles, such as body parts in automobile manufacturing, may be clamped between the clamping arm 42 and the jaw member.

The toggle lever mechanism may also have additional actuating members associated with it, e.g. a centering pin.

In a refinement of the illustrated embodiment, the clamping arm 42 may be associated with a welding electrode, so that between the welding electrode and an opposite element (e.g. a second electrode) one may perform spot welding of articles clamped at high compressive force.

The clamping arm 42 may also be in the form of a clinch component or an impressing or stamping element, driven at high compressive force by the toggle lever mechanism.

As may be seen, in the open position (FIG. 2) the connecting levers 26 and 27 extend around the worm gear wheel 14 and its shaft 15, on one side thereof.

Advantageously the drive part 5 may comprise an ordinary commercially available electric motor of operating voltage 24 V (for example). In general, any ordinary electrical motor, whether DC or AC, may be employed.

Sensors, e.g. microswitches (43, 44), are provided on a sheet metal piece 45, forming a single replaceable unit (module). These modules are commonly known as "sets" or "plates". They may be inserted into the inner space 10 of the head part 1 via a slot or slots on the front, side, or rear of the housing 2, 3. Preferably the replaceable module covers and protects the respective slot on or with respect to the outside. Unneeded slots may be covered with appropriate sheet metal strips. In this way the overall device can be mounted from all four sides, even the rear side, without a need to depart from the standard dimensions of, e.g., toggle-lever clamping devices, centering cylinders, stamping or pressing devices, or clinch devices. If the slots are on the front and rear sides, they are narrow and extend in the direction of the longitudinal axis of the head part 1; wherewith, e.g., threaded blind holes may be provided on both sides of the slots to enable installing the apparatus on a production line (e.g. the body assembly line of an automobile factory).

As seen from FIG. 3, the clamping arm 42 as shown has a forked U-shaped structure so that the arm 42 can be swung through its excursion via the swing pin 37 which extends laterally beyond the head part 1.

What is claimed is:

1. An implement comprising a head part, a drive part adjoining the head part in a longitudinal direction, which drive part is associated with an actuating member which is drivable in opposite directions, which actuating member is coupled to a toggle lever mechanism via which mechanism an arm of a toggle-lever device is drivable, the drive part having an electric motor which drives the toggle lever mechanism via a transmission device, and wherein a worm is coupled to a shaft of the electric motor, which worm together with a worm gear wheel which is engaged by said worm is disposed in an interior space of the head part, a dog coupled to the worm gear wheel, and a swing pivot coupled to said dog, a longitudinal axis of said swing pivot being parallel to a shaft of the worm gear wheel, said swing pivot of the dog having coupled to it on diametrically opposite sides of the wheel two respective connecting levers which engage said pivot between them, each of the levers cooperating with respective members of the toggle lever mechanism.

2. The implement according to claim 1, wherein the shaft of the worm is rotatably mounted in the interior space of the head part by two spaced apart bearings.

3. The implement according to claim 1, wherein each connecting lever is comprised of two lever members the longitudinal axes of which are at a mutual oblique angle, an apex of this angle being disposed laterally of the longitudinal axis of the worm and being directed away from said axis so that when the implement is in its open position the lever members of each connecting lever extend around the shaft of the worm gear wheel at an overall angle of greater than 180°.

4. The implement according to claim 1, wherein an end region of each of the connecting levers farthest from the dog and the swing pivot is rotatably coupled on a pin which bears respective guide rolls on the pin's respective end regions, each of the guide rolls being forcibly guided in rotational movement with a respective longitudinal guide groove, the grooves being formed in interior sides of a housing of the head part and extending mutually parallel and parallel to the longitudinal axis of the worm and the shaft of the worm, whereby a member of the toggle lever mechanism is disposed between the connecting levers, which member is rotatably mounted in the middle cross sectional plane across an axis of the pin.

5. The implement according to claim 4, wherein each of the guide rolls is rotatably mounted using a bearing.

6. The implement according to claim 1, wherein the shaft of the worm gear wheel extends outwardly from the head part, such extension being on at least one side of the head part, and such extension bearing at least one coupling being connectable to at least one hand lever for manual actuation of the implement.

7. The implement according to claim 1, further comprising at least one sensor disposed in the interior space.

8. The implement of claim 7, wherein the at least one sensor is one of a microswitch, an inductive switch, and a pneumatic switch.

9. The implement of claim 7, wherein the at least one sensor is displaceable from the interior region of the head part.

10. The implement according to claim 7, wherein the at least one sensor is disposed on a sheet metal piece thereby forming a single replaceable module.

11. The implement according to claim 10, wherein said replaceable module is insertable into the inner space of the head part via a slot formed in the head part, said module sealing said slot impermeably with respect to the exterior of the head part.

12. The implement according to claim 10, wherein suitable attachment means in the form of at least one of threaded blind holes, quick connections, and bores are provided on all four sides of the head part, whereby the replaceable module is insertable and removable when necessary without disturbing the mounting or operation of the tool, such insertion or removal being facilitated by slots for the module provided on each of the four sides of the head part.

13. The implement according to claim 12, further comprising threaded attachment holes provided on both sides of each slot to permit a cover to be coupled over any unused slot.

14. The implement according to claim 1, wherein the transmission device is self-locking.

15. The implement according to claim 1, wherein the drive part is provided with a battery for an emergency power supply.

16. The implement according to claim 1, wherein the worm and worm gear wheel are comprised of a plastic material.

17. The implement according to claim 16, wherein at least one of the worm and worm gear wheel is produced from a block of plastic material which in the fluid state bears polytetrafluoroethylene flakes, whereby upon hardening said flakes are uniformly distributed in the mass of the supporting body in a maximally homogenous fashion, whereby when the interengaging surface areas the worm and worm gear wheel are subjected to machining and wear, these flakes become prominent or exposed.

18. The implement according to claim 1, wherein the arm is a clamping arm of a toggle-lever clamping device.

19. The implement according to claim 1, wherein the arm includes a welding electrode of a toggle-lever welding arm.

20. The implement according to claim 1, wherein the arm is a broach.

21. The implement according to claim 1, wherein the arm is a mandrel.

22. The implement according to claim 1, wherein the arm is an impressing device.

23. The implement according to claim 1, wherein the arm is a stamping device.

* * * * *